US008376702B2

(12) United States Patent
Gorali

(10) Patent No.: US 8,376,702 B2
(45) Date of Patent: Feb. 19, 2013

(54) UNIVERSAL FAN BLADE MOUNT AND CEILING FAN EMPLOYING SAME

(75) Inventor: Yuval Gorali, Yafo (IL)

(73) Assignee: Yuval Gorali, Yafo (IL)

( * ) Notice: Subject to any disclaimer, the term of this patent is extended or adjusted under 35 U.S.C. 154(b) by 390 days.

(21) Appl. No.: 12/604,567

(22) Filed: Oct. 23, 2009

(65) Prior Publication Data

US 2010/0135810 A1 Jun. 3, 2010

Related U.S. Application Data

(60) Provisional application No. 61/108,228, filed on Oct. 24, 2008.

(51) Int. Cl.
*F04D 29/36* (2006.01)

(52) U.S. Cl. ..... 416/5; 416/204 R; 416/205; 416/219 A; 416/220 A; 416/244 R

(58) Field of Classification Search ..... 416/5, 60, 416/204 R, 205, 206, 207, 208, 209, 210 R, 416/214 R, 219 A, 220 A, 244 R, 246, 234
See application file for complete search history.

(56) References Cited

U.S. PATENT DOCUMENTS

| | | | | |
|---|---|---|---|---|
| 1,566,272 | A * | 12/1925 | Costa | 416/60 |
| 2,658,577 | A * | 11/1953 | Sprouse | 416/244 R |
| 4,936,751 | A * | 6/1990 | Marshall | 416/246 |
| 5,489,191 | A * | 2/1996 | Tai | 416/5 |
| 6,352,411 | B1 * | 3/2002 | Bucher et al. | 416/210 R |
| 6,382,917 | B1 * | 5/2002 | Zuege | 416/210 R |
| 6,494,682 | B1 | 12/2002 | Blateri et al. | |
| 6,659,723 | B2 * | 12/2003 | Bankstahl | 416/204 R |
| 6,802,694 | B2 | 10/2004 | Bucher et al. | |

* cited by examiner

*Primary Examiner* — Christopher Verdier
(74) *Attorney, Agent, or Firm* — Kilpatrick Townsend & Stockton LLP

(57) ABSTRACT

A universal fan blade mount for connecting an integral fan blade assembly having two or three or four fan blades to a fan blade rotor, wherein the fan blade mount includes an adapter plate having a plurality of peripheral holes each for accommodating a respective mounting pin of the fan blade assembly, at least one of the holes being configured to accommodate a mounting pin of any one of the fan blade assemblies.

10 Claims, 3 Drawing Sheets

UNIVERSAL FAN BLADE MOUNT AND CEILING FAN EMPLOYING SAME

RELATED APPLICATION

This application claims priority to U.S. Application Ser. No. 61/108,228, filed Oct. 24, 2008, the disclosure of which is incorporated by reference in its entirety for all purposes.

FIELD OF THE INVENTION

This invention relates to an adapter for a universal fan blade.

BACKGROUND OF THE INVENTION

Ceiling fans are very popular for facilitating air circulation in homes and businesses and different manufacturers provide ceiling fans to the public. Owing to the fact that fan blades are constructed in varying lengths, rotors are available in a variety of diameters, and the mounts are manufactured to join fan blades to specific rotors, the fan blades of one manufacturer are generally not compatible with the mounting assembly of a different manufacturer's fan. Indeed, often different models of the same manufacturer are incompatible. This makes maintenance of a ceiling fan in the event of damage difficult and often dictates replacement of the complete fan assembly.

There is therefore a need for a universal fan blade adapter which can attach a fan blade to any conventional rotor, regardless of the spacing of the attachment holes on the rotor. Universal adapters for ceiling fans are well-known in the patent literature.

For example, U.S. Pat. No. 4,936,751 (Marshall) discloses a universal fan blade mounting assembly including an elongated bar having flanges at each end. One of the flanges is shaped to cooperate with one end of a fan blade and the other flange is constructed for attachment to a ceiling fan rotor. The rotor connecting flange includes two holes therein and one of the holes is round for encircling a fastening screw. The other hole forms an arcuate slot. The hole and slot cooperate such that the elongated bar extends outwardly from the center of the rotor such that the functional relationship between the fan blade and the rotor may be maintained.

U.S. Pat. No. 6,802,694 discloses overhead ceiling fans having easily attachable and detachable blades.

U.S. Pat. No. 6,494,682 discloses a fan assembly in which a block member is connected to a rotor end casing and an arm member having a blade connected thereto is mounted to the block member.

These patents are merely representative of universal ceiling fan assemblies and in order to obviate the need to describe features that are known per se, their complete contents are incorporated herein by reference.

In addition to replacing broken fan blades, it is also often desirable to upgrade a ceiling fan so as to provide more power by replacing, for example, a two-blade fan to a three-blade fan and so on. At least some of the above-referenced patents appear to allow for this possibility by providing discrete fan blades, each of which can be fitted into an appropriate location of the fan assembly via an intermediate mounting adapter. For example, U.S. Pat. No. 6,802,694 requires that separate fan blades be attached to the fan motor via respective intermediate mounting arms.

But it is known to provide ceiling fans that have multiple blades all formed as a single integral unit. In this case, it would be preferable to attach the single fan blade assembly to the motor via a single-piece adapter thus reducing the number of components in the final assembly.

It is also known to attach fan blades to a flywheel of a ceiling fan. For example, Switchco sell ceiling fan parts for different makes of ceiling fan, including blade arms, pull chain switches, capacitors, flywheels, PC boards, and wall switches. One such flywheel is reproduced herein as FIG. 1. It is seen in FIG. 1 that the flywheel has multiple holes disposed around a periphery of the flywheel for accommodating six blades. The flywheel itself is screw-mounted to the motor shaft via a central boss and screw. Other flywheels for accommodating four blades are also available as are flywheels that can accommodate either four or five blades as shown in the following table.

| Catalog # | Shaft Size | # of Blades | Ceiling Fans |
|---|---|---|---|
| F16 | 16 MM (5/8") | 4 | Tara, Sunbeam, Patton, Homestead, Home-Pride, and Pre 1980 Casablanca - |
| F16M | 16 MM (5/8") | 4 or 5 | Tara, Sunbeam, Patton, Homestead, Home-Pride, and Pre 1980 Casablanca - |
| F17 | 17 MM (43/64") | 4 | Homestead, Quoizel, American Industries, Old Jacksonville, Key Largo, Great American, and 985-990 Fasco - |
| F17M | 17 MM (43/64") | 4 or 5 | Homestead, Quoizel, American Industries, Old Jacksonville, Key Largo, Great American, and 985-990 Fasco - |
| F20 | 20 MM (25/32") | 4 or 5 | Kenroy, North American's Park Avenue, and Americana |
| F25 | 25 MM (1/") | 4 or 5 | Casablanca, Home Pride, Emerson, and U.S. Fan |
| FH | 17 MM (43/64") | 4 | Hunter 52" Comfort Breeze, Robbines, and Myers Part No. 83067 |
| FHN | 17 MM (43/64") | 4 | Late Model Hunters, Robbins, and Myers Part No. 83147 and 83096 |
| FH42 | 17 MM (43/64") | 4 | Hunter 42" Comfort Breeze, Robbins, and Myers Part No. 83060. |
| FHS6 | 17 MM (43/64") | 6 | Homestead, Six Blade: This Model |
| FHS6/A | 17 MM (43/64") | 6 | Homestead, Six Blade: |
| FHS66M | 17 MM (43/64") | 6 | Homestead, Six Blade: |
| F1745 | 17 MM (43/64") | 4 or 5 | Riccar, Jet King, Tacony, Litco's Sierra, and Some Gulf Coast - |

-continued

| Catalog # | Shaft Size | # of Blades | Ceiling Fans |
|---|---|---|---|
| F1745M | 17 MM (43/64") | 4 or 5 | Riccar, Jet King, Tacony, Litco's Sierra, and Some Gulf Coast |
| F2045 | 20 MM (25/32") | 4 or 5 | Riccar, Jet King, Tacony, and Litco's Sierra |
| F8037 | 17 MM (43/64") | 6 | Fasco Six Blade (948 & 962) |
| F8047 | 17 MM (43/64") | 5 | 552, 548, 965, 960, 330, and 961 Fasco Five Blade |
| F8076 | 17 MM (43/64") | 4 or 5 | Fasco and Others, This Flywheel Has The Same Blade Arm Pattern As The F25, Except It's For A 17 MM Shaft |
| F8076M | 17 MM (43/64") | 4 or 5 | Fasco and Others, This Flywheel Has The Same Blade Arm Pattern As The F25, Except It's For A 17 MM Shaft |
| F2052 | 20 MM (25/32") | 4 or 5 | Casablanca First Home, (988 Fasco), Concord Madison, and Sierra. Has Four Holes In The Center To Attach To Motor + A Set Screw |
| F20M | 20 MM (25/32") | 4 or 5 | Has Four Bolt Holes In The Center To Attach Flywheel To Fan Motor + A Set Screw To Attach To Motor Shaft |

So far as is known by the present Applicant, there is no known flywheel assembly that is adapted to accommodate three different types of integral fan blade assembly having respectively, 2, 3, or 4 blades.

SUMMARY OF THE INVENTION

It is therefore a primary object of the invention is to provide a fan blade mount that is adapted to accommodate an integral fan blade assembly having two, three or four blades.

Another object of the invention is to provide a universal fan blade mount which can be used as a replacement part on a variety of ceiling fans regardless of whether they are manufactured by the same or different manufacturers.

This object is realized in accordance with the invention by a universal fan blade mount for connecting an integral fan blade assembly having two, three or four fan blades to a fan blade rotor, the fan blade mount comprising:

an adapter having a plurality of peripheral holes each for accommodating a respective mounting pin of the fan blade assembly, and at least one of said holes being configured to accommodate a mounting pin of any one of said fan blade assemblies.

In accordance with a further embodiment there is provided a ceiling fan assembly comprising:

a rotor, a universal fan blade mount being rotatably connected to said rotor, and an integral fan blade assembly having a plurality of fan blades, wherein said plurality is two, three or four fixedly attached to respective holes in the universal fan blade mount.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

Figure 1:
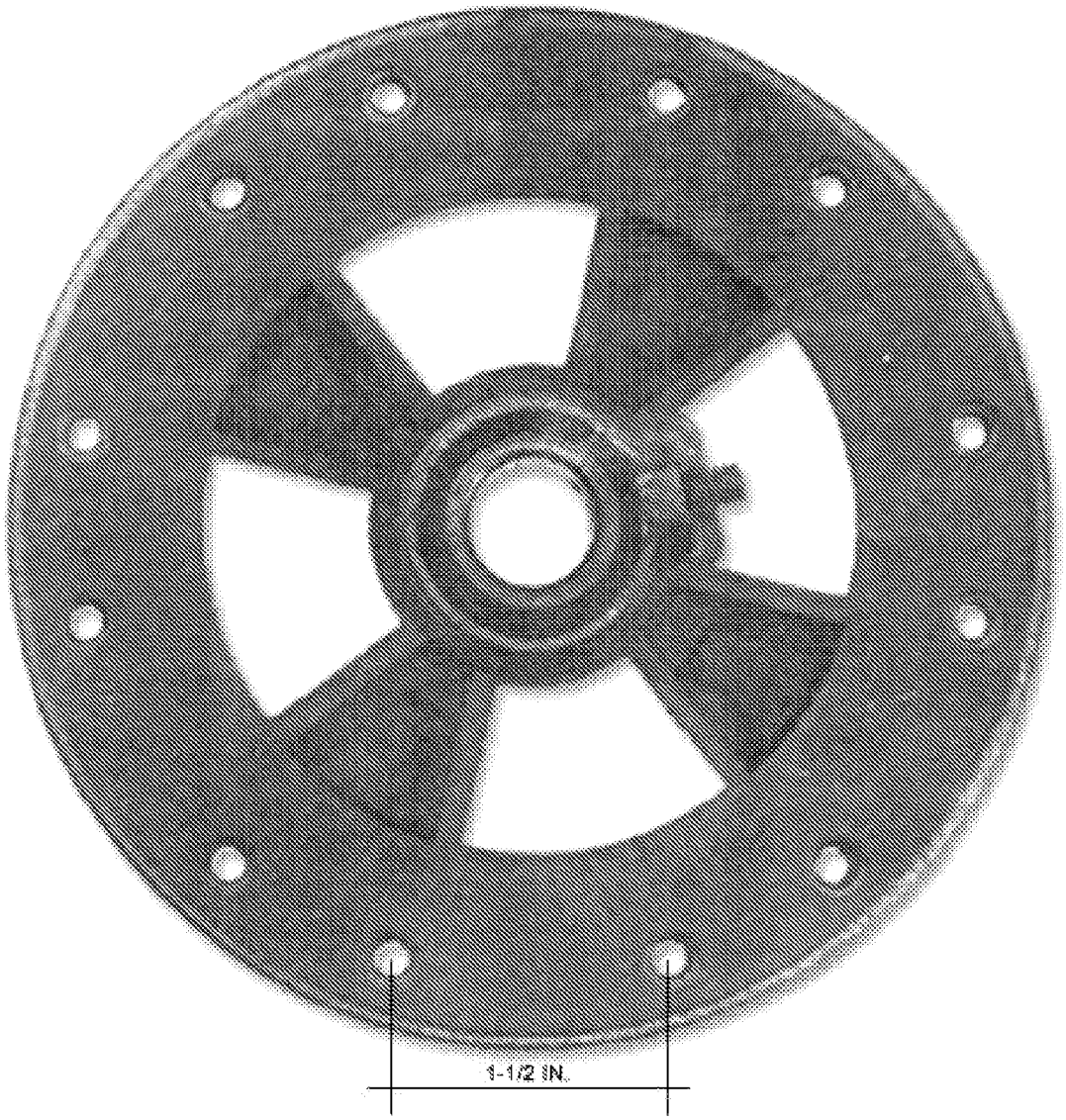
FIG. 1 (PRIOR ART)
FIG. 1 shows a prior art flywheel for mounting different numbers of discrete fan blades thereto in proper relative angular displacement.

FIG. 1 shows a prior art flywheel for mounting different numbers of discrete fan blades thereto in proper relative angular displacement.

Figure 2:
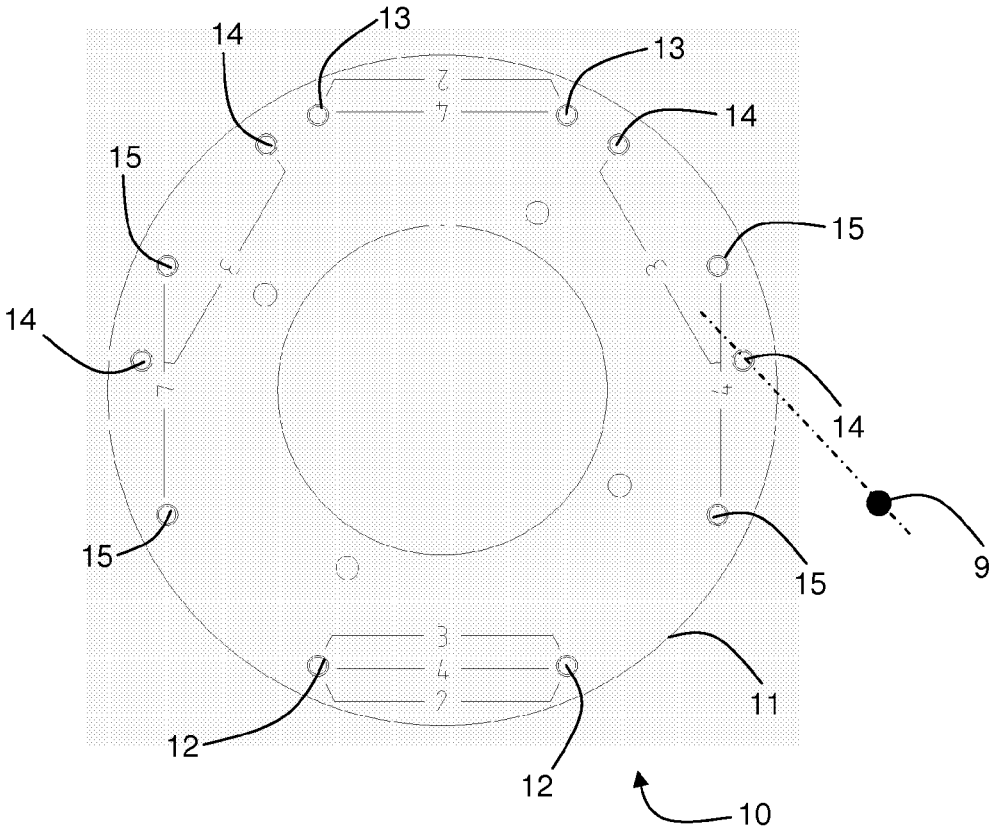
FIG. 2 shows schematically a flywheel according to the invention for accommodating different fan blade assemblies each having two, three or four integral fan blades in proper relative angular displacement.

FIG. 2 shows schematically a universal fan blade mount 10 according to an embodiment of the invention for accommodating different fan blade assemblies each having two, three or four integral fan blades in proper relative angular displacement. The fan blade mount 10 comprises a flywheel 11 having a plurality of peripheral holes 12 to 15 each for accommodating a respective mounting pin 9 of a fan blade assembly. The holes are arranged in groups such that a first group 12 is configured to accommodate a mounting pin of any one of the fan blade assemblies regardless of whether it has two, three or four blades. A second group 13 accommodates only those fan blades having two or four blades, while a third group 14 accommodates only those fan blades having three blades, and a fourth group 15 accommodates only those fan blades having four blades.

In one embodiment, there are disposed around the periphery of the flywheel 11 two adjacent holes in the first group 12, there being disposed adjacent each of the holes 12 a first pair of holes containing a hole in the fourth group 15 followed by a hole in the third group 14. This first pair is followed by an identical second pair of holes containing a hole in the fourth group 15 followed by a hole in the third group 14. This leaves two opposing holes in the third group between which there are formed two holes in the second group 13. All of the holes are angularly spaced in proper disposition for mounting any one of the fan blade assemblies to the respective holes. Thus, the flywheel serves as an adapter plate for mounting different fan blade assemblies on the ceiling fan rotor.

Figure 3A:
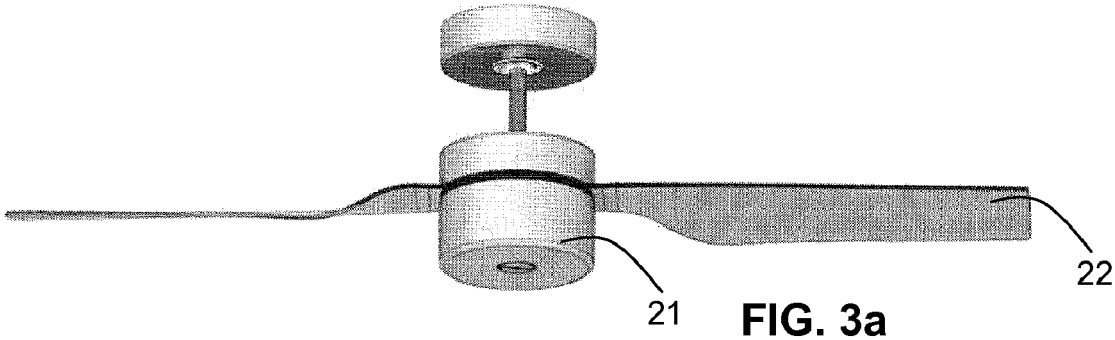
FIGS. 3*a*, 3*b* and 3*c* are pictorial representations of ceiling fans having fan blade assemblies with two, three or four integral fan blades, respectively, mounted in proper relative angular displacement via the flywheel shown in FIG. 2.
Figure 3B:
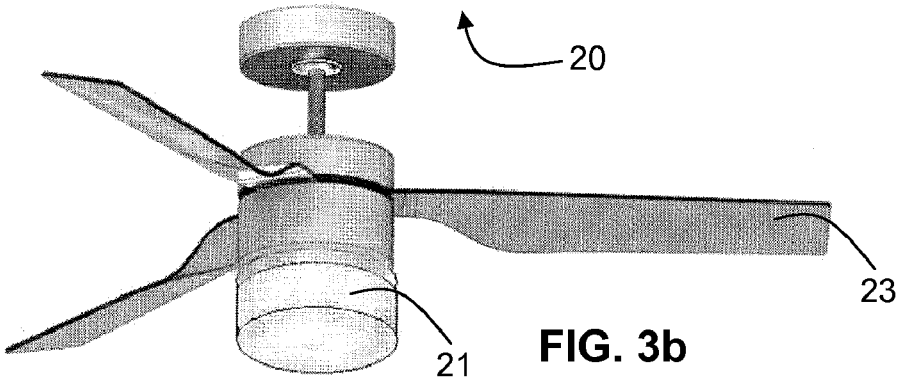
Figure 3C:
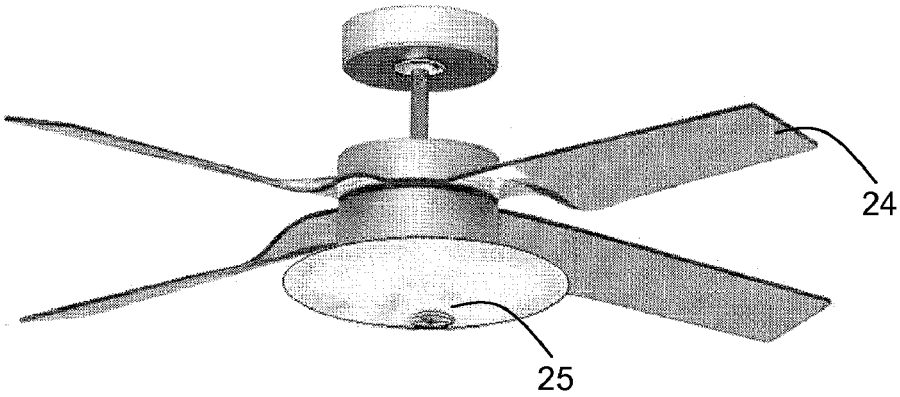

FIGS. 3*a* to 3*c* show a ceiling fan assembly 20 according to the invention comprising a rotor housing 21 to which there are attached respective integral fan blade assemblies 22, 23 and 24 having respectively two, three and four blades fixedly attached to respective holes in a universal fan blade mount (now shown) rotatably mounted on the rotor housing 21. In FIG. 3*c*, the rotor housing 21 supports a lamp module 25 so that the resulting ceiling fan assembly 20 has an integral lamp.

While the universal fan blade mount has been described with particular reference to the embodiment shown in FIG. 2, it will be understood that it is capable of further modification, uses and/or adaptations of the invention which follow in general the principle of the invention and includes such departures from the present disclosure as come within known or customary practice in the art to which the invention pertains, and as may be applied to the central features herein before set forth, and fall within the scope of the invention or the limits of the appended claims.

In particular, it should be noted that while in the preferred embodiment described with reference to FIG. 2, the fan blade assembly is attached to the rotor by a flywheel, other adapter plates may be used. Thus the invention is not limited to use of a flywheel and embraces other means for mounting an integral fan blade assembly having two, three or four blades to the same fan rotor.

The invention claimed is:

1. A universal fan blade mount that connects three different types of integral fan blade assemblies having, respectively, two, three, and four fan blades to a fan blade rotor, each of the fan blades being fixed to a support in equal relative angular displacement, the fan blade mount comprising:

an adapter plate having a plurality of peripheral holes each accommodating a respective mounting pin of the respective fan blade assembly, and at least one of said holes being configured to accommodate a respective mounting pin of any one of said fan blade assemblies.

2. The universal fan blade mount of claim 1, wherein the peripheral holes include a first group of holes for accommodating any one of said fan blade assemblies, a second group for accommodating only those fan blade assemblies having two or four blades, a third group for accommodating only those fan blade assemblies having three blades, and a fourth group for accommodating only those fan blade assemblies having four blades.

3. The universal fan blade mount of claim 2, wherein:

the first group contains two adjacent holes, on each side of the first group there is disposed a respective first pair of holes of which a first hole in the first pair of holes proximate the first group is a hole in the fourth group and a second hole in the first pair of holes remote from the first group is a hole in the third group, proximate each of the second holes in the respective first pair of holes there is disposed a respective second pair of holes of which a first hole in the second pair of holes proximate the second hole in the respective first pair of holes is a hole in the fourth group and a second hole in the second pair of holes remote from the second hole in the respective first pair of holes is a hole in the third group, between the respective second holes in the second pair of holes belonging to the third group there is disposed a third pair of holes corresponding to the third group, and all of said holes are angularly spaced in proper disposition for mounting any one of said fan blade assemblies to the respective holes in said groups.

4. The universal fan blade mount of claim 2, wherein:

the first group contains two adjacent holes, on each side of the first group there is disposed a respective first pair of holes of which a first hole is a hole in the fourth group and a second hole is a hole in the third group, proximate each of the second holes in the respective first pair of holes there is disposed a respective second pair of holes of which a first hole is a hole in the fourth group and a second hole is a hole in the third group, between the respective second holes in the second pair of holes belonging to the third group there is disposed a third pair of holes corresponding to the third group, and all of said holes are angularly spaced in proper disposition for mounting any one of said fan blade assemblies to the respective holes in said groups.

5. The universal fan blade mount of claim 1, wherein the adapter plate comprises a flywheel containing said peripheral holes.

6. A ceiling fan assembly comprising:

a rotor, and a universal fan blade mount rotatably connected to said rotor and accommodating three different types of integral fan blade assemblies having, respectively, two, three, and four fan blades fixedly attached to respective holes in the universal fan blade mount, each of said holes accommodating a respective pin of a support to which all the fan blades of the respective fan blade assembly are fixed in equal relative angular displacement.

7. The ceiling fan assembly according to claim 6, further comprising an integral lamp module.

8. A universal fan blade mount connecting three different types of integral fan blade assemblies having, respectively, two, three and four fan blades to a fan blade rotor, the fan blade mount comprising:

an adapter plate having a plurality of peripheral holes each accommodating a respective mounting pin of the respective fan blade assembly, and at least one of said holes being configured to accommodate a respective mounting pin of any one of said fan blade assemblies;

wherein the peripheral holes include a first group of holes accommodating any one of said fan blade assemblies, a second group accommodating only those fan blade assemblies having two or four blades, a third group accommodating only those fan blade assemblies having three blades, and a fourth group accommodating only those fan blade assemblies having four blades.

9. The universal fan blade mount of claim 8, wherein:

the first group contains two adjacent holes, on each side of the first group there is disposed a respective first pair of holes of which a first hole in the first pair of holes proximate the first group is a hole in the fourth group and a second hole in the first pair of holes remote from the first group is a hole in the third group, proximate each of the second holes in the respective first pair of holes there is disposed a respective second pair of holes of which a first hole in the second pair of holes proximate the second hole in the respective first pair of holes is a hole in the fourth group and a second hole in the second pair of holes remote from the second hole in the respective first pair of holes is a hole in the third group, between the respective second holes in the second pair of holes belonging to the third group there is disposed a third pair of holes corresponding to the third group, and all of said holes are angularly spaced in proper disposition for mounting any one of said fan blade assemblies to the respective holes in said groups.

10. The universal fan blade mount of claim 8, wherein the adapter plate comprises a flywheel containing said peripheral holes.

* * * * *